US005077914A

United States Patent [19]

Yamamoto

[11] Patent Number: 5,077,914

[45] Date of Patent: Jan. 7, 1992

[54] HAIR DRYING BRUSH OF WATER ABSORPTION TYPE

[76] Inventor: Yasuo Yamamoto, 25-18, Shimoochiai 4-Chome, Shinjuji-ku, Tokyo-to, Japan

[21] Appl. No.: 640,050

[22] Filed: Jan. 11, 1991

[30] Foreign Application Priority Data

Jan. 18, 1990 [JP] Japan ..... 2-7192

[51] Int. Cl.[5] ..... F26B 13/26

[52] U.S. Cl. ..... 34/95; 132/110; 132/109; 132/108; 34/96

[58] Field of Search ..... 34/3, 70, 89.1, 95, 34/96; 132/108, 109, 110, 111, 120; 15/160

[56] References Cited

U.S. PATENT DOCUMENTS 807,127 12/1905 Powers ..... 34/95
1,039,982 10/1912 Maley ..... 132/110
1,169,028 1/1916 Grove ..... 34/95
2,895,487 7/1959 Hazzard ..... 132/110
4,421,129 12/1983 Wingard ..... 132/120
4,566,472 1/1986 Mueller et al. ..... 132/110
4,856,541 8/1989 Kellett et al. ..... 132/110

FOREIGN PATENT DOCUMENTS 224735 11/1924 United Kingdom ..... 132/110
590971 8/1947 United Kingdom ..... 132/108

*Primary Examiner*—Henry A. Bennett
*Assistant Examiner*—Denise L. F. Gromada
*Attorney, Agent, or Firm*—Price, Heneveld, Cooper, DeWitt & Litton

[57] ABSTRACT

A brush for drying hair has a body with a hollow interior. The body has opposed surfaces with the surface on one side having teeth arranged in a more open or less dense pattern than the teeth on the opposite surface. The teeth on each face pass through a non-woven fabric sheet of water absorbant material with inner ends of the teeth seated in recesses in the inner body of the head of the brush. The non-woven fabric on one surface of the brush is isolated from the non-woven fabric on the other face so that its water absorbing function is isolated from the fabric on the other surface.

15 Claims, 3 Drawing Sheets

HAIR DRYING BRUSH OF WATER ABSORPTION TYPE

SUMMARY OF THE INVENTION

A brush for drying hair has a body with a hollow interior. The body has opposed surfaces with the surface on one side having teeth arranged in a more open or less dense pattern than the teeth on the opposite surface. The teeth on each face pass through a non-woven fabric sheet of water absorbent material with inner ends of the teeth seated in recesses in the inner body of the head of the brush. The non-woven fabric on one surface of the brush is isolated from the non-woven fabric on the other face so that its water absorbing function is isolated from the fabric on the other surface.

BACKGROUND OF THE INVENTION

Although the hair fashion inclusive of hair length and hair style changes with the times, there is always a deeply rooted aspiration for so-called "long hair", and this trend is reflected by a fact that, recently, 70 to 80% of high school students, unmarried women up to about 25 years old and even married women, particularly being childless, are long-haired.

Meanwhile, people in our country tend to desire "comfortableness" in their daily life more and more as the national economic state is stabilized and, with a consequence, a life style such as bathroom equipment and bathing manners has been created, which is substantially different from the conventional one. For example, many young women take hair shampooing every morning before going to their schools or offices and such habit commonly called "morning shampooing" has been established as a new life style in our country.

People have been well-informed of hair care science and commonly have learned the fact that the cuticle comprising 18 amino acids and forming the epidermis of hair is sensitive to heat and alkali and blown hot air drying for a long time after "morning shampooing" would seriously damage hair, causing elasticity loss of the hair, destruction of the cuticle and causing the hair to be split and/or broken.

Conventional methods of hair drying after shampooing can be generally classified into "spontaneous drying", "blot-up drying" with a towel and "blown hot air drying" with an electric hair dryer.

Said spontaneous drying method is initiated by primary draining off, i.e., towel drying immediately after shampooing.

After such towel drying, a certain amount, typically 5 to 10 g of water still remains, depending on hair length, and hair brushing or combining in such state would cause water to drip from the hair strand tips which is uncomfortably cold for the skin. Shampooing with one's clothes on would wet clothes. Accordingly, the towel hair drying step will be followed by spontaneous hair drying with a dried towel wrapping the still wet hair like a turban. Such method would require, although depending on an amount of hair, approximately 1 hour and is troublesome for women having the previously mentioned habit of "morning shampooing" and sometimes cause them to get a cold.

To shorten the time otherwise taken for said spontaneous hair drying, after the towel drying, hair is parted into small sections which are then successively blotted up with a dried towel held between both hands. Such method is the so-called "blot-up" hair drying method.

From the viewpoint of the fact that scrubbing hair with a towel might damage hair even if this towel is fairly soft, this blot-up hair drying method is certainly advantageous to the health of the hair.

However, this blot-up procedure also is time-consuming and requires further brushing thereafter because hair strands tend to cling together immediately after shampooing and to resist a comb or brush used to part hair into small sections.

The blown hot air drying method with use of an electric hair dryer is not preferable for hair which is, as has previously been mentioned, sensitive to heat. Air blown at a low temperature would require a time period as long as approximately 30 minutes for adequate evaporation of water held among the hair strands.

In addition to the above-mentioned hair drying methods of well-known art, there have already been proposed several types of absorptive towel, for example, those known by the names of "quick dry towel" and "non-dry towel". Furthermore, water-absorptive combs or brushes have also been disclosed, for example, by U.S. Pat. No. 4,421,129; Japanese Patent Application Disclosure Gazette No. 1985-20827; and Japanese Utility Model Application Disclosure Gazette No. 1984-105405.

PROBLEM TO BE SOLVED BY THE INVENTION

While the blot-up hair drying method, with use of said water-absorptive towel, will be effective to achieve safe hair drying, the scrubbing of the hair with such water-absorptive towel will disadvantageously lead to damage of hair cuticles as well as prolonging the time required for hair drying.

The invention disclosed by the above-mentioned U.S. Pat. No. 4,421,129 utilizes a graft copolymer of starch as water absorbent material. Upon water absorption, this graft copolymer of starch is liable to hydrolysis and becomes uncomfortably slimy and is difficult to dry after use. Additionally, such graft copolymer of starch is restricted in its absorptivity and readily swollen to clog the comb teeth, making this invention unsuitable, particularly for long hair.

The brushes as disclosed by the above-mentioned Japanese Patent Application Disclosure Gazette No. 1985-20827 and Japanese Utility Model Application Disclosure Gazette No. 1984-105405 have been developed primarily for hair shampooing or coloring and not for hair drying by water absorption. Even if these brushes can be used for hair drying by water absorption, they will not be effective in practical use, particularly for water absorption drying of long hair, because these prior art brushes have no adequate water absorption capacity.

When a large quantity of water is held between hair strands, brushing is heavily resisted by these hair strands, but such brushing resistance is weakened as the quantity of water held between the hair strands is reduced and consequently a brush with coarse teeth will not be able to capture hair strands.

In view of the problems that have been mentioned above, it is an object of the present invention to provide a novel hair drying brush of water absorption type allowing effective hair drying by water absorption to be achieved, even for long hair, simultaneously with hair brushing without any risk of damaging hair and also allowing the time required for hair drying prior to hair dressing to be effectively shortened.

BRIEF DESCRIPTION OF THE INVENTION

The object set forth above is achieved, according to one aspect of the present invention, by a hair drying brush of the water absorption type comprising a brush teeth carrier or body and a plurality of brush teeth extending from said brush body with the surface of said brush body being coated, around roots of said brush teeth, with a non-woven fabric as a water absorbent material, wherein said non-woven fabric as water absorbent material is divided into at least two sections and these sections are spaced and isolated from one another.

The object is also achieved, according to another aspect of the invention, by a hair drying brush of the water absorption type comprising a grip, a brush teeth carrier or body connected to said grip and a plurality of brush teeth projecting from said brush body with the surface of the brush body being coated around the roots of said brush teeth with a non-woven fabric as a water absorbent material, wherein said non-woven fabric, as water absorbent material, is divided into a pair of sections so as to define a pair of layers opposed to each other and these sections of non-woven fabric are spaced from each other and wherein the brush teeth associated with one of said layers are coarsely or sparsely distributed while the brush teeth associated with the other layer are densely distributed.

The hair drying brush of the water absorption type constructed, according to the invention as has been described above, may be used following the towel drying procedure after shampooing to achieve hair parting smoothly and simultaneously to bring hair strands in contact with the associated layer of non-woven fabric as water absorbent material, so as to absorb thereby the moisture held among hair strands. The amount of water absorbed by the one layer of non-woven fabric during the primary water absorption process performed on the hair strands while holding between them a relatively plentiful quantity of water immediately after shampooing is never transferred to the other layer of non-woven fabric on the opposite face of the brush, since the first mentioned layer of non-woven fabric is spaced from the last-mentioned layer of non-woven fabric. Accordingly, a secondary process of water absorption may be conducted using the other layer of non-woven fabric after some amount of the water has been absorbed by the primary water absorption process to accelerate hair drying by water absorption. The hair drying effect is further enhanced by brushing.

Said primary water absorption process may be made by using the layer of non-woven fabric associated with the coarse teeth to achieve a proper water absorbing effect, even for the hair strands exhibiting a high brushing resistance. After some quantity of water has been absorbed and consequently the brushing resistance has been reduced to such a degree that it becomes difficult for the coarsely distributed teeth to capture the hair strands, water absorptive brushing may then be continued using the densely distributed teeth so that the hair strands can be more firmly captured in order to finish the secondary water absorption process more efficiently without any danger of damaging the hair strands.

The present invention will be more apparently understood from the following description of the preferred embodiments made in reference with the accompanying drawings.

DESCRIPTION OF THE PREFERRED EMBODIMENT

Figure 1:
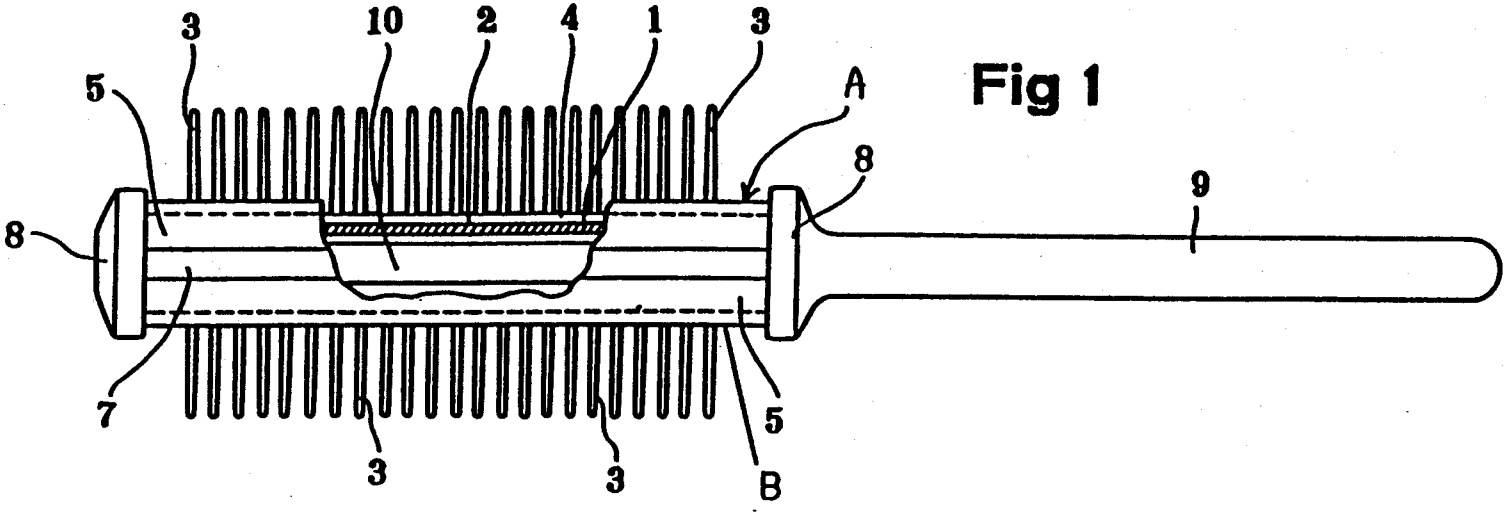
FIG. 1 is a front view, partially broken away, showing a preferred embodiment of the hair drying brush of water absorption type constructed in accordance with the invention.

A pair of brush teeth carriers or holders 1 and 1*a* are combined with each other to form a hollow shell having a substantially elliptical cross section. More specifically, each of said brush teeth carriers 1 and 1*a* comprises a somewhat thick semicylindrical shell. While the brush teeth carriers 1 and 1*a* are illustrated as each having a semi-elliptical cross section, this cross section may be also relatively flat semicylindrical substantially semicircular or even rectangular.

Each brush teeth carrier 1 and 1*a* has formed in its surface a plurality of brush teeth supporting grooves 2 extending longitudinally thereof. In the specific embodiment illustrated, the one carrier 1 is formed with four grooves 2 while the other carrier 1*a* is formed with seven grooves 2 so that said one carrier 1 supports coarsely or widely distributed brush teeth extending from the surface A defined by this carrier 1 and the other carrier 1*a* supports densely distributed brush teeth extending from the surface B defined by the other carrier 1*a*.

A plurality of brush teeth 3, are provided for each of the surfaces A and B of the brush and to form a plurality of comb-like components, each having a plurality of teeth which are integrally formed. More specifically, each comb-like component comprises a plurality of brush teeth 3 joined integrally by a base or link lever 4 having a width slightly larger than the diameter of the brush teeth 3 or 3*a*. The respective link levers 4 or bases are positioned in the respective brush teeth supporting grooves 2 formed in the surface of the brush teeth carriers 1 and 1*a* so that these brush teeth extend radially outwardly from the brush teeth carriers 1 and 1*a*.

Figure 2:
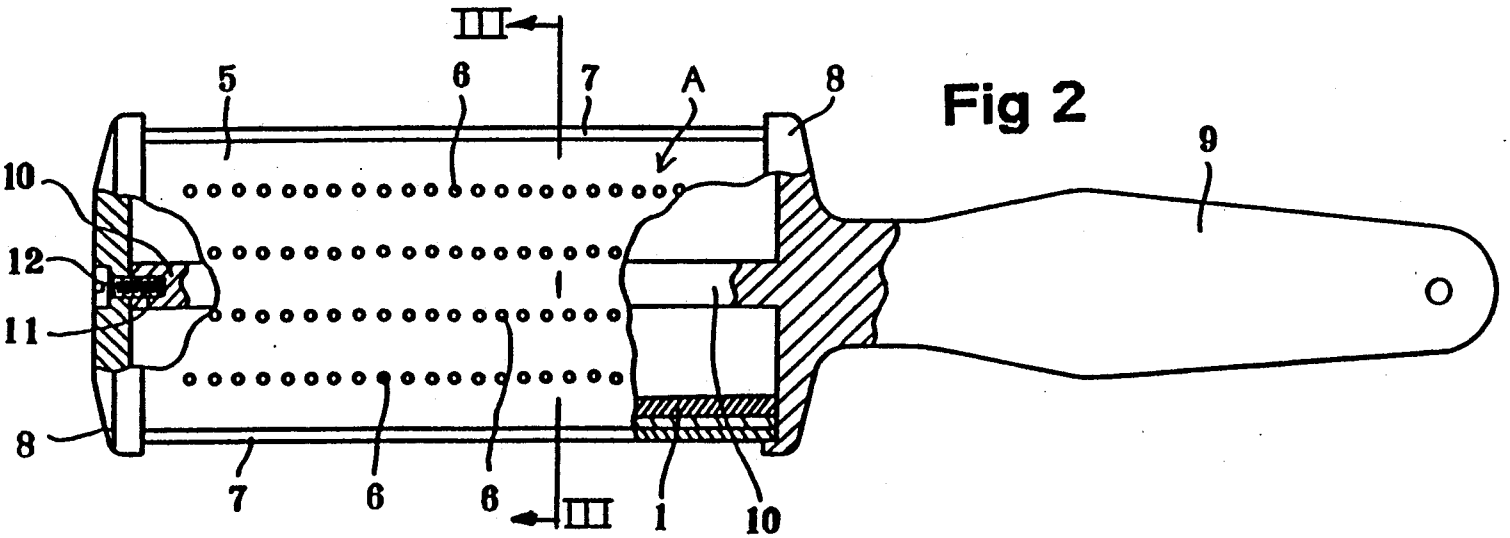
FIG. 2 is a plan view, partially broken away, schematically showing the brush teeth.
Figure 3:
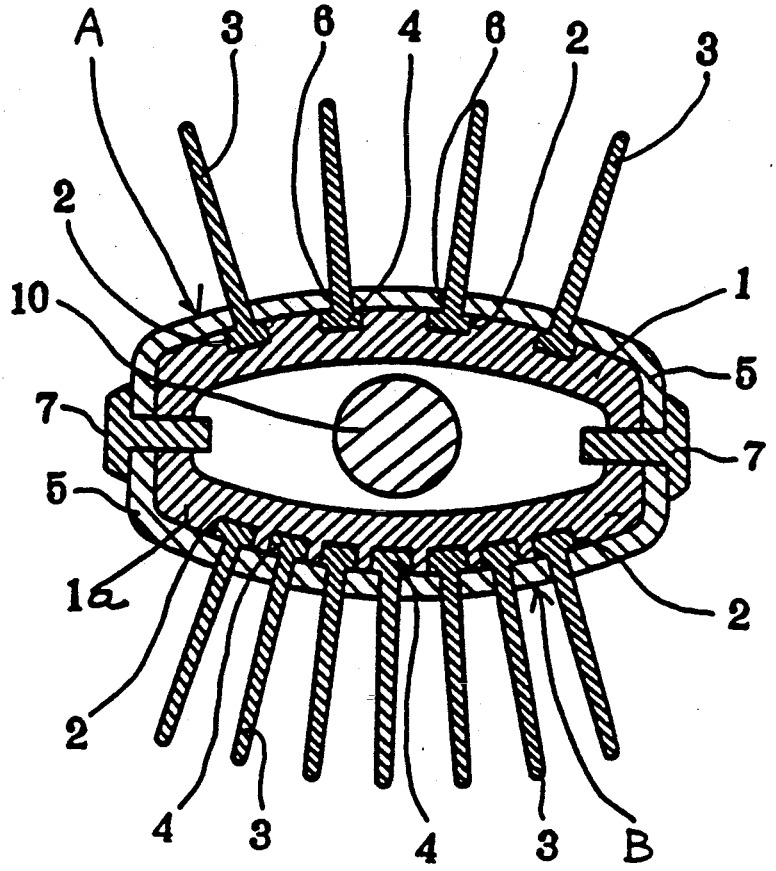
FIG. 3 is a sectional view taken along the plane III—III of FIG. 2.

Reference numeral 5 designates two separate sheets of non-woven fabric serving as water absorbent material and the respective surfaces A, B are each coated with one of these non-woven fabric sheets 5. To facilitate such coating, the respective sheets of non-woven fabric 5 are formed with a plurality of through-holes 6, 6 through which the respective brush teeth 3 and 3*a* extend (FIG. 2). This water absorbent material preferably comprises a sheet of non-woven fabric adapted for water absorption through capillary phenomenon and having a thickness in the order of 2 mm and a water absorbing capacity of 15 to 17 g/10 $cm^2$. However, the specific thickness and water absorbing capacity are not critical for the invention and any other felt-like water absorbent may be used without departing from the scope of the invention, provided it can offer an appropriate absorbing effect through the capillary phenomenon. While this non-woven fabric 5, as a water absorbent, preferably can be dried for reuse, it may be also of the disposable type.

The layers of non-woven fabric 5 as the water absorbent defining the surfaces A, B, opposed to each other, are spaced from each other. To this end, a pair of spacer members or levers 7, 7, serving also as holders, are interposed between the brush teeth carriers 1 and 1*a* defining the surfaces A, B opposed to each other, and coated with the associated layers of non-woven fabric 5, 5 serving as water absorbents so that the respective layers of non-woven fabric 5, 5 are spaced from each other and edges of these layers are held on the brush teeth carriers 1 and 1*a*.

Figure 4:
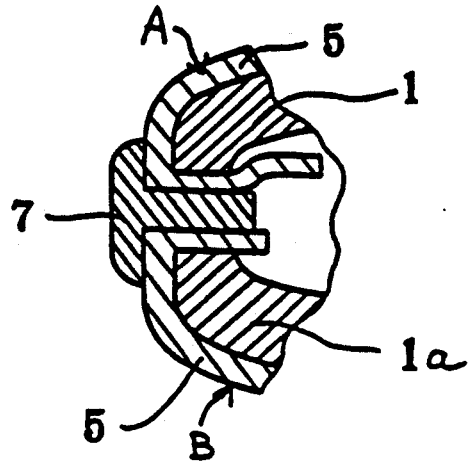
FIG. 4 is a fragmentary sectional view of a modified embodiment of the invention.

Referring to FIG. 4, another embodiment of the invention is shown in fragmentary section, in which the edges of said non-woven fabric layers 5, 5 extend into the inner cavity formed by the brush teeth carriers 1 and 1*a* so as to improve the water absorbing capacity of said non-woven fabric layer 5, particularly on the surface A associated with the widely, that is coarsely distributed brush teeth.

Reference numerals 8, 8 designate clamp members adapted to clamp together said brush teeth carriers 1 and 1*a*, the non-woven fabric layers 5, 5 serving as water absorbents and the spacer members 7, 7 serving also the holders at their opposite ends, respectively.

One of these clamp members 8 is formed integrally with a grip 9 and provided with an axially extending shaft 10 which is, in turn, provided at its forward end with a threaded hole 11 so that a screw 12 extending through a hole formed in the other clamp member 8 may be threaded into said threaded hole 11 to clamp together the entire brush.

Figure 5:
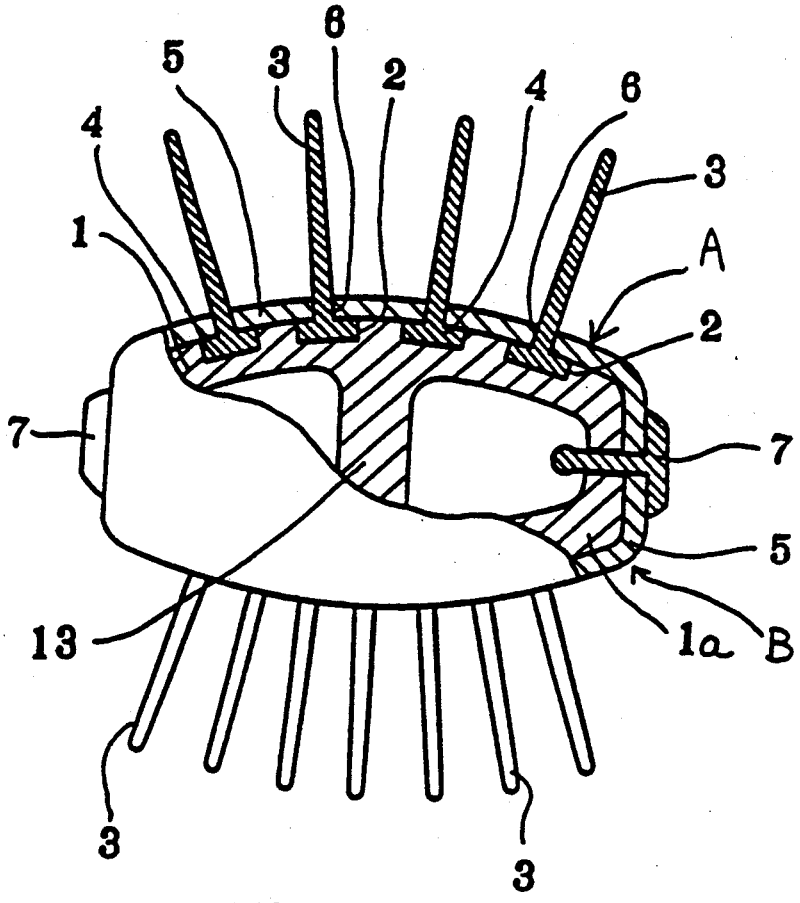
FIG. 5 is a sectional view taken along the same plane as FIG. 3, illustrating a modification of the invention.

FIG. 5 illustrates still another embodiment of the invention in which the brush teeth carrier is formed integrally with the grip 9. While the embodiments shown by FIGS. 1 through 4 include a pair of separate brush teeth carriers defining the surfaces A, B opposed to each other, respectively, the embodiment shown by FIG. 5 comprises these brush teeth carriers 1 and 1*a* defining the surfaces A, B opposed to each other, respectively, being formed integrally with a support member 13 interposed therebetween so that the gaps defined between respectively opposed side edges of the brush teeth carriers 1 and 1*a* are resiliently enlarged or restricted to receive the spacer levers 7 serving also as the fabric holders and thereby to clamp the non-woven fabric layers 5, 5.

Use of the hair drying brush of the water absorption type constructed, as has been described hereinabove, allows the moisture content held among the hair strands to be quickly absorbed by the non-woven fabric layers 5, 5 under the capillary phenomenon occurring therein. To be able to absorb a relatively large amount of the water held among the hair strands, immediately after they have been shampooed, the surface A associated with the coarsely distributed brush teeth 3 is used first for brushing considering the high resistance to brushing at this stage not only to hair parting but also water absorption by the layer of non-woven fabric 5 associated with this surface A brushing can be smoothly achieved. During and after such brushing with use of the non-woven fabric layer 5 associated with the surface A and, therefore, with the coarsely distributed brush teeth, the moisture content absorbed by the surface A is never transferred to the surface B and the latter remains dry, since said non-woven fabric layer 5 on the surface A is spaced and isolated from said non-woven fabric layer 5 on the surface B.

Accordingly, after water absorption has been substantially completed with the surface A thereon carrying the coarsely distributed brush teeth 3 and the brushing resistance also has been correspondingly reduced, the surface B, carrying thereon the densely distributed brush teeth, may be used to capture the hair strands so firmly as to absorb the remaining amount of moisture smoothly and quickly. Thus, quick and efficient hair drying by water absorption is achieved.

As will be apparent from the foregoing description that use of the hair drying brush of water absorption type constructed in accordance with the invention, following the so-called "towel drying" immediately after shampooing, allows hair drying by water absorption to be quickly and smoothly made in a comfortable manner. In addition, hair strands can be smoothly parted by brushing into small sections for efficient drying by water absorption and more or less moisture content held among the hair strands can be easily accommodated. Furthermore, switching between the surface carrying thereon the coarsely distributed brush teeth and the surface carrying thereon the densely distributed brush teeth allows the hair trying efficiency to be improved. Therefore, a relatively short time is sufficient even for long hair. One of the most important features of the invention is that hair drying can be performed simultaneously with hair brushing, providing an optimum hair drying brush for the health of the hair.

It should be understood that the hair drying brush of this invention is applicable also for animal hair.

I claim:

1. A hair drying brush of water absorption type comprising a body having a brush teeth carrier and a plurality of brush teeth rising from said brush teeth carrier, a surface of said brush teeth carrier being coated around the roots of said brush teeth with a non-woven fabric as a water absorbent, wherein said non-woven fabric as water absorbent is divided into at least two sections and these sections are spaced and isolated from one another, said teeth being arranged in two groups spaced from each other with each group contacting a different one of the fabric sections, said teeth having a header portion seated in openings in said body, said headers being held against said body by said fabric.

2. A hair drying brush of water absorption type as recited in claim 1, wherein said brush teeth having anchor means and said brush teeth being arranged like comb teeth with the anchor means for each of the brush teeth being positioned in a groove formed in the brush teeth carrier so as to orient the brush teeth to extend radially outwardly from the brush teeth carrier.

3. A hair drying brush of water absorption type as recited in claim 2, wherein each of said anchor means has a width slightly larger than a diameter of the brush tooth.

4. A hair drying brush of water absorption type as recited in claim 1 wherein said brush teeth carrier has an inner cavity and the edges of said non-woven water absorbent fabric extend into said inner cavity.

5. A hair drying brush of water absorption type comprising a grip, a brush teeth carrier connected to said grip and a plurality of brush teeth projecting from said brush teeth carrier and arranged in two groups isolated from each other, the surface of said brush teeth carrier being coated around roots of said brush teeth with non-woven fabric as water absorbent, wherein said non-woven fabric as water absorbent is divided into a pair of sections so as to define a pair of layers facing oppositely from each other and said sections of water absorbent non-woven fabric being spaced and moisture isolated from each other and each section associated with only one of said groups of brush teeth, said brush teeth associated with one of said layers being coarse while the brush teeth associated with the other layer are dense.

6. A hair drying brush capable of water absorption, said brush having a body, a plurality of brush teeth projecting outwardly from opposite faces of said body and recess means in said faces of said body seating the root ends of said teeth, a non-woven water absorbent fabric seated against each of said faces of said body with said teeth extending therethrough in moisture receiving relationship to said teeth, said fabric contacting one face being isolated from the fabric contacting the other face whereby each provides an independent moisture absorbing means, said fabric acting as a retainer for said teeth holding said teeth in said recess.

7. A hair drying brush capable of water absorption as described in claim 6 wherein said body has means for clamping the perimetrical edges of said fabric thereto.

8. A hair drying brush capable of water absorption, said brush having a body, said body having a pair of oppositely directed faces, a plurality of brush teeth projecting outwardly from each of said faces of said body and recess means in each of said faces of said body seating one end of the teeth projecting from the face adjacent thereto, a non-woven water absorbent fabric seated against and overlying each of said faces with the teeth projecting from the faces over which the fabric lies extending therethrough in moisture receiving relationship to said teeth and the spaces therebetween, said body having moisture non-absorbent means separating the adjacent edges of the fabric on opposite faces thereof.

9. A hair drying brush capable of water absorption as described in claim 8 wherein the spacing between the brush teeth projecting from one of said faces is greater than the spacing between the brush teeth projecting from the other of said faces whereby the brush teeth on said one side are adapted to provide initial removal of water from the hair and the brush teeth on the other side are adapted to substantially remove the remaining portion of the water.

10. A hair drying brush capable of water absorption as described in claim 8 wherein said non-absorbing means is a spacer element seated between said oppositely directed faces, said spacer element being moisture impervious for isolating the moisture absorbent fabric of one of the faces from that of the other of said faces.

11. A hair drying brush capable of water absorption as described in claim 10 wherein the perimetrical edges of said absorbent fabric covering said opposite faces are isolated from each other.

12. A hair drying brush capable of water absorption as described in claim 11 wherein means are provided on both ends of said body for connecting said oppositely directed faces, said means at one end being detachably mounted to said body whereby the edges of said absorbent fabric can be released.

13. A hair drying brush capable of water absorption as described in claim 8 wherein said body is formed of a pair of shell elements against an outer face of which said water absorbent fabric is seated, a moisture impervious member seated between said shell elements for spacing said elements and the perimetrical edges of the fabric on each of said shell elements from each other.

14. A hair drying brush capable of water absorption as described in claim 13 wherein the interior of said body is hollow.

15. A hair drying brush capable of water absorption as described in claim 14 wherein the perimetrical edges of said fabric extend into the hollow interior of said body and are clamped against said moisture impervious member.

* * * * *

UNITED STATES PATENT AND TRADEMARK OFFICE

CERTIFICATE OF CORRECTION

PATENT NO. : 5,077,914

DATED : January 7, 1992

INVENTOR(S) : Yasuo Yamamoto

It is certified that error appears in the above-identified patent and that said Letters Patent is hereby corrected as shown below:

Column 8, claim 10, line 9:
"non-absorbing" should be --non-absorbent--.

Signed and Sealed this

Twenty-eighth Day of December, 1993

*Attest:*

Bruce Lehman

BRUCE LEHMAN

*Attesting Officer*

*Commissioner of Patents and Trademarks*